US011391511B1

(12) United States Patent
Thomas et al.

(10) Patent No.: US 11,391,511 B1
(45) Date of Patent: Jul. 19, 2022

(54) METHODS AND SYSTEMS FOR HYDROGEN LIQUEFACTION

(71) Applicant: JTurbo Engineering & Technology, LLC, Sugar Land, TX (US)

(72) Inventors: Jacob Thomas, Sugar Land, TX (US); Nickey Jacob Thomas, Sugar Land, TX (US)

(73) Assignee: JTurbo Engineering & Technology, LLC, Sugar Land, TX (US)

( * ) Notice: Subject to any disclaimer, the term of this patent is extended or adjusted under 35 U.S.C. 154(b) by 0 days.

(21) Appl. No.: 17/398,151

(22) Filed: Aug. 10, 2021

Related U.S. Application Data

(60) Provisional application No. 63/164,312, filed on Mar. 22, 2021, provisional application No. 63/135,686, filed on Jan. 10, 2021.

(51) Int. Cl.
*F25J 1/02* (2006.01)
*F25J 1/00* (2006.01)

(52) U.S. Cl.
CPC ..... *F25J 1/001* (2013.01); *F25J 1/005* (2013.01); *F25J 1/008* (2013.01); *F25J 1/0042* (2013.01); *F25J 1/0067* (2013.01); *F25J 1/0072* (2013.01); *F25J 1/0204* (2013.01); *F25J 1/0235* (2013.01); *F25J 2245/90* (2013.01); *F25J 2270/16* (2013.01)

(58) Field of Classification Search
CPC .. F25J 1/001; F25J 1/0067; F25J 1/005; F25J 1/0072; F25J 1/0204; F25J 1/0042; F25J 2245/90; F25J 2270/16
See application file for complete search history.

(56) References Cited

U.S. PATENT DOCUMENTS 3,092,461 A 6/1963 Vander et al.
3,380,809 A 4/1968 Newton
3,735,600 A 5/1973 Dowdell et al.
(Continued)

FOREIGN PATENT DOCUMENTS

WO 2017072018 A1 5/2017
WO 2018105565 A1 6/2018
(Continued)

OTHER PUBLICATIONS

K. Stolzenburg and R. Mubbala, Integrated Design for Demonstration of Efficient Liquefaction of Hydrogen (IDEALHY), Hydrogen Liquefaction Report, Dec. 16, 2013, 33 pages, PLANET GbR.
(Continued)

*Primary Examiner* — John F Pettitt, III
(74) *Attorney, Agent, or Firm* — K&L Gates LLP

(57) ABSTRACT

Systems and methods for liquefying a gaseous hydrogen that include a first refrigeration stage and a second refrigeration stage. The first refrigeration stage includes a first heat exchanger configured to flow a first refrigerant to pre-cool the gaseous hydrogen. The second refrigeration stage includes a second heat exchanger configured to flow a second refrigerant to liquefy and sub-cool the hydrogen. The second refrigerant is split into two streams that flow through two compressor-expanders and multiple passes through the second heat exchanger before being recombined to repeat the second refrigeration stage circuit.

30 Claims, 8 Drawing Sheets

(56) References Cited

U.S. PATENT DOCUMENTS

| | | | | |
|---|---|---|---|---|
| 3,992,167 | A | 11/1976 | Beddome | |
| 4,765,813 | A | 8/1988 | Gaumer, Jr. et al. | |
| 5,768,912 | A | 6/1998 | Dubar | |
| 5,916,260 | A | 6/1999 | Dubar | |
| 6,467,274 | B2 | 10/2002 | Barclay et al. | |
| 6,591,632 | B1 | 7/2003 | Mahoney | |
| 7,040,119 | B2 | 5/2006 | Bracha et al. | |
| 7,127,914 | B2 | 10/2006 | Roberts et al. | |
| 9,557,101 | B2 | 1/2017 | Bonnissel et al. | |
| 9,644,888 | B2 | 5/2017 | Ishimaru et al. | |
| 9,752,825 | B2 | 9/2017 | Bauer | |
| 9,777,959 | B2 | 10/2017 | Bonnissel et al. | |
| 10,309,718 | B2 | 6/2019 | Kim | |
| 10,393,431 | B2 | 8/2019 | Roesch et al. | |
| 10,605,522 | B2 | 3/2020 | Mak et al. | |
| 10,837,700 | B2 | 11/2020 | Cardella et al. | |
| 10,928,127 | B2 | 2/2021 | Cardella et al. | |
| 2005/0217281 | A1 | 10/2005 | Adler et al. | |
| 2013/0118204 | A1 | 5/2013 | Higginbotham et al. | |
| 2014/0053598 | A1* | 2/2014 | Ishimaru | F25J 1/004 62/606 |
| 2017/0205140 | A1 | 7/2017 | Kim | |
| 2018/0313604 | A1 | 11/2018 | Cardella et al. | |
| 2018/0320957 | A1 | 11/2018 | Cardella et al. | |
| 2020/0003070 | A1 | 1/2020 | Yamazoe et al. | |

FOREIGN PATENT DOCUMENTS

| | | | |
|---|---|---|---|
| WO | 2018115456 | A1 | 6/2018 |
| WO | 2018134846 | A1 | 7/2018 |
| WO | 2019082642 | A1 | 5/2019 |
| WO | 2019166383 | A1 | 9/2019 |
| WO | 2020156754 | A1 | 8/2020 |
| WO | 2020259990 | A1 | 12/2020 |
| WO | 2021021824 | A1 | 2/2021 |

OTHER PUBLICATIONS

K. Stolzenburg et al., Efficient Liquefaction of Hydrogen: Results of the IDEALHY Project, Efficient Liquefaction of Hydrogen: Results of the IDEALHY Project, Nov. 7-9, 2013, 8 pages, XXth energie—symposium, Stralsund/Germany.

Windmeier, et al., Cryogenic Technology, Cryogenic Technology, Sep. 2013, 72 pages, Ullmann's Encyclopedia of Industrial Chemistry.

* cited by examiner

| Technology | Status | Pre-cooling Cycle | Liquefaction & Sub-cooling Cycle | Specific energy Consumption (SEC) kWh/kg | Exergy Efficiency (%) |
|---|---|---|---|---|---|
| | | | | | |
| Linde-Ingolstadt | Operating | LN2 | H2 - Claude | 13.60 | 28.82 |
| Linde-Leuna | Operating | LN2 | H2 - Claude | 11.90 | 32.94 |
| Air Products | 6 x Operating | LN2 | H - Claude | 12 - 15 | 33 - 26 |
| Praxair | 4 x Operating | LN2 | H2 - Claude | 12.5 - 15 | 31 - 26 |
| Air Liquide | 5 x Operating | LN2 | H2 - Claude | 12 - 15 | 33 - 26 |
| Shimko | Study | None | He - Reverse Brayton | 8.73 | 44.90 |
| WE-NET | Study | LN2 | He - Reverse Brayton | 8.69 | 45.11 |
| WE-NET | Study | LN2 | N2 - Reverse Brayton | 8.58 | 45.69 |
| WE-NET | Study | LN2 | H2 - Claude | 8.53 | 45.96 |
| Quack | Study | Propane | Ne/He - Reverse Brayton | 6.93 | 56.57 |
| IDEALHY | Study | Mixed Refrigerant | Ne/He - Reverse Brayton | 6.74 | 58.14 |
| Figure 1 & 2 | Patent-Pending | N2 - Reverse Brayton | He - Reverse Brayton | 5.35 | 73.22 |
| Figure 1 & 2 | Patent-Pending | N2 - Reverse Brayton | H2 - Reverse Brayton | 5.29 | 74.10 |
| Figure 1 & 2 | Patent-Pending | N2 - Reverse Brayton | H2+Ne - Reverse Brayton | 5.20 | 75.46 |
| Figure 3 | Patent-Pending | LNG | H2+Ne - Reverse Brayton | 3.61 | 108.74 |
| | | | | | |
| NOTE: $H_2$ Plant Feed Gas & Liquefaction Pressure @ 1160 psig (80 barg) and $H_2$ Storage @ 14.5 psig (1.0 barg) | | | | | |

FIG. 4

| Description | PTEXP $N_2$/ $H_2$+Ne Cycle | TEXP $N_2$/ $H_2$+Ne Cycle | TEXP $N_2$/ $H_2$ Cycle | TEXP $N_2$/ He Cycle | PLNG-LIN/ TEXP N2/ H2+Ne Cycle |
|---|---|---|---|---|---|
| Hydrogen feed Gas (MMSCFD) | 24.85 | 24.85 | 24.85 | 24.85 | 24.85 |
| Liquid Hydrogen Loading (kg/day) | 60,022 | 60,022 | 60,022 | 60,022 | 60,022 |
| Specific Energy Consumption (kW/kg) | 4.895 | 5.195 | 5.290 | 5.354 | 3.605 |
| Exergy efficiency (%) | 80.08 | 75.46 | 74.11 | 73.22 | 108.75 |
| Total Power (kW) | 12,243 | 12,992 | 13,229 | 13,389 | 9,015 |
| Power Balance (%) | 0.942 | 1.000 | 1.018 | 1.031 | 0.694 |

FIG. 5

METHODS AND SYSTEMS FOR HYDROGEN LIQUEFACTION

BACKGROUND

This section is intended to provide relevant background information to facilitate a better understanding of the various aspects of the described embodiments. Accordingly, these statements are to be read in this light and not as admissions of prior art.

The technologies of hydrogen liquefaction have been developing rapidly due to prospective energy exchange effectiveness, zero emissions, and long distance and economic transportation. However, hydrogen liquefaction is one of the most energy-intensive industrial processes. A small reduction in specific energy consumption ("SEC") and an improvement in efficiency may decrease the operating cost of the entire process. Among the existing technologies, the SEC of most hydrogen liquefaction processes is limited in the range of 6.7-12 kWh/kg liquid hydrogen ("LH2"). The exergy efficiencies of these processes are around 60% to 30%.

As an energy carrier and the most plentiful element on Earth, hydrogen is primarily derived from water and can address issues of sustainability, environmental emissions, and energy security. The demand for LH2, particularly driven by clean fuel cell applications, is expected to have a rapid growth, and the number of hydrogen refueling stations in the world will also rise sharply in the near future. In view of a mobility based on hydrogen, the distribution and storage of hydrogen as a liquid is one of the most feasible options in terms of energy density, technical, and economic perspectives. In addition, the density of LH2 is much higher than gaseous hydrogen, resulting in higher energy content. In the coming decades, innovative energy supplies, advanced energy systems, and upgraded infrastructure will be needed to meet the increasing energy demands sustainably. Hydrogen liquefaction processes will play indispensable roles in clean energy chain.

Liquefaction of hydrogen is a cost-efficient way to store and transport large quantities of hydrogen over extended distances and can offer a low-pressure, high energy density fuel to be used in a variety of applications. Hydrogen gas is liquefied when it is cooled down to a temperature below −425° F. at atmospheric pressure.

New large-scale hydrogen liquefaction plants with production capacities of, for instance, from 10 to 300 tons per day ("tpd"), will require thermodynamically and economically efficient process designs. SEC, and thus operational costs, should be significantly reduced compared to prior concepts described in Ohlig, et al. ("Hydrogen, 4. Liquefaction" Ullmanns's Encyclopedia of Industrial Chemistry), while utilizing available turbo machinery and cryogenic process equipment design and frame sizes.

Presently liquefied natural gas ("LNG") is being used to replace diesel in many heavy-duty vehicles, including refuse haulers, grocery delivery trucks, transit buses, and coal miner lifters. Likewise, it would be desirable to integrate liquefaction with LNG truck fueling operations to allow for even greater delivery flexibility. With the conceptual development of green new fuel and energy, liquefied hydrogen will gradually replace LNG and play an important role in long-distance and large-scale transportation.

U.S. Pat. No. 10,330,382 to John Mak, et. al. teaches the use of a gas expander, compressor and plate, and fin heat exchangers for systems and methods for LNG production with propane and ethane recovery. U.S. Pat. No. 10,605,522 to John Mak, et. al. also teaches the use of a pre-cooling system for natural gas and a gas expander, compressor, and plate & fin heat exchangers for LNG liquefaction. Conventional gas compression and expansion techniques have been applied to natural gas pre-cooling in other gas processing facilities for many years. However, conventional gas compression and expansion techniques have not been used for pre-cooling the feed gas to LNG liquefaction until recently.

Small to large-scale hydrogen liquefaction pants are typically defined with liquefaction capacities from 10-300 tpy. These smaller plants must be simple in design, safe, easy to operate, and robust with consideration of limited staffing in plant operation. The simpler processes, such as gaseous ($N_2$/$H_2$—Ne)/$H_2$/He) expander cycle, are preferred.

The hydrogen liquefaction processes may be divided into two parts, namely a pre-cooled liquefaction process and a cascade liquefaction process. For example, a LH2 plant may use a mixed refrigerants ("MRs") pre-cooling cycle and four $H_2$/He/$H_2$—Ne Joule-Brayton (J-B) cycle cascade refrigeration system. As an example, the overall power consumption of a proposed plant may be 6.7-8.7 kWh/kg LH2 and the exergy efficiency ("EXE") was 60-40%. While these known methods are more energy efficient than earlier inventions/operating plants with an SEC of 12-15 kWh/kg LH2, such methods are often complex, requiring circulating several levels of pure hydrocarbon refrigerants or multiple mixed hydrocarbon refrigerant and costly to operate.

Over the years, gaseous ($N_2$ and $H_2$—Ne/$H_2$/He/) expander cycle efficiency has been improved by advances in equipment designs, such as turbo-expanders, compressors, heat exchangers, brazed aluminum heat exchangers, and process configurations on multi-stage design. For example, turbo-expanders with high isentropic efficiencies which are designed with energy recovery, via booster compressors or turbo-generators, increase the overall process efficiency. However, energy and cost-effective turbo-expanders are currently limited by rotational speeds and available frame-sizes. While equipment efficiency has reached its limit, the next step to further the improvement is to develop an economical method for hydrogen liquefaction and eliminate the temperature approach inefficiency.

Thus, while all or almost all of the known configurations and methods provide some advantages over previously known configurations, various disadvantages remain.

BRIEF DESCRIPTION OF THE DRAWINGS

Embodiments of the methods and systems for hydrogen liquefaction are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

FIG. 4 is a table showing a comparison of previous hydrogen liquefaction processes with the processes shown in FIGS. 1-3;

FIG. 5 is a table showing operating and performance parameters of the hydrogen liquefaction processes of FIGS. 1-3;

DETAILED DESCRIPTION

The present invention relates to methods for liquefying gaseous streams consisting of/or comprising hydrogen ($H_2$) liquefaction facilities, where hydrogen gas is liquefied and sub-cooled using refrigerant working fluids in $1^{st}$ and $2^{nd}$ stage cryogenic heat exchanger cold boxes, or using liquid nitrogen ("LIN")/LNG for pre-cooling in the $1^{st}$ stage followed by $2^{nd}$ stage cryogenic heat exchanger cold box, providing cooling down to temperatures close to the liquid hydrogen product temperature.

In an embodiment, a system for providing high pressure hydrogen gas stream to a liquefaction plant may comprise a compressor configured to receive a first hydrogen gas stream at a first pressure and produce a second hydrogen gas stream at a second pressure; an exchanger, wherein the exchanger is configured to receive the second hydrogen gas stream at the second pressure and cool the second hydrogen gas stream to produce a cooled hydrogen gas stream.

In other embodiments, a hydrogen liquefaction plant or system, where the working fluid for the 1st and 2nd stage cryogenic heat exchanger cold box is a refrigerant fluid limited to nitrogen, neon, hydrogen, and helium as well as to mixtures of these. LIN/LNG are used for pre-cooling in the 1st stage followed by 2nd stage cryogenic heat exchanger cold box. The system provides cooling of the LH2 down to temperatures below approximately −280° F. to −407° F. and close to the LH2 product temperature.

The embodiments use twin expanders coupled in series with $N_2/H_2$—$Ne/H_2/He$ J-B refrigeration cycle system to improve overall effects on efficiency and performance. The contemplated methods and configurations also include a single refrigerant or refrigerant mixture for a closed-loop first and second stage refrigeration cycle for small and large-scale liquefiers. This configuration is optimized in terms of plant energy-efficiency, while reducing the total number of turbo machinery, as well as the plant operational complexity and capital costs. Compared to previous designs for cold refrigeration cycles in large-scale hydrogen liquefaction plants, the embodiments reduce SEC by as much as 30-40%, e.g., 5.2 kWh/kg LH2, which is significantly lower than other processes, typically in the range of 6.7-12 kWh/kg LH2, thus enabling an economical production of liquid hydrogen on a large-scale for clean energy applications.

The term "expander-compressor" as used herein refers to a single-stage or multi-stage expander compressor. The compressor typically comprises an axial compressor, a centrifugal compressor, or like compressors with a polytropic efficiency of 80-85% or higher, while the expander can be an axial machine with isentropic efficiency of 80-88% or higher.

Figure 1:
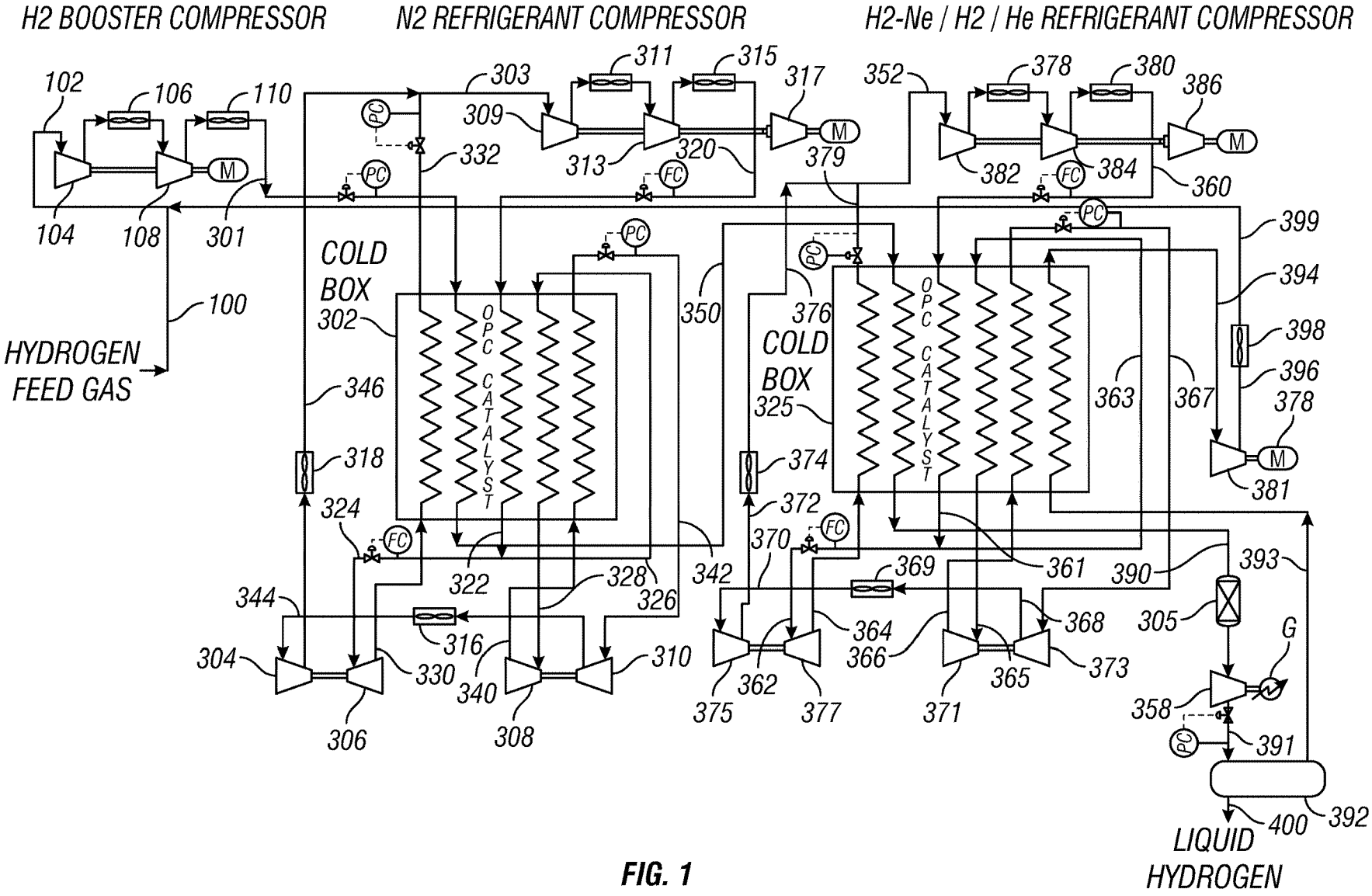
FIG. 1 is an equipment and process flow diagram for an embodiment of a hydrogen liquefaction plant or system in accordance with principles disclosed herein.

Referring now to the figures, FIG. 1 illustrates a hydrogen booster compressor, where a hydrogen gas stream 100 and the flash/boil off gas ("BOG") recycle stream in a conduit 399 combine into a conduit 102 before being fed to a booster compressor 104 and 108, which may be driven by an electric motor. The outlet gas stream may be cooled in air coolers 106 and 110, to produce cold high pressure gas stream 301 at appropriate conditions for entering the hydrogen liquefaction process first stage cryogenic heat exchanger (cold box) 302. For example, the hydrogen gas stream in the conduit 301 may be at a liquefaction pressure of 1,160 psig (80 barg) and a temperature of 5-95° F.

The typical operating pressure of a blue/green hydrogen production facility using steam methane reforming ("SMR")/proton electrolyte membrane ("PEM") electrolysis process is 350-600 psig. The higher operating pressure can significantly reduce the power consumption by the first & second stage refrigeration compressors in the hydrogen liquefaction process. The nitrogen refrigeration compressor is typically driven by at least two compression stages. The refrigerant fluid can be gaseous nitrogen in a multiple stage expander cycle.

The hydrogen gas stream in the conduit 301 then enters and is further cooled in the cold box 302 to produce a cold hydrogen gas stream in a conduit 350, wherein the cold hydrogen gas stream is at, for example, a pressure of 1,150 psig and a temperature of, for example, −285° F.

The hydrogen gas stream can be processed/treated in the cryogenic heat exchanger (cold box) 302 pass/core, packed with ortho-para conversion ("OPC") catalyst, to pre-convert normal-hydrogen (25%) para to a para-fraction near equilibrium in the cold hydrogen gas stream 350, before routing it to the second cryogenic heat exchanger (cold box) 325 for the liquefaction and sub-cooling cycle. The OPC catalyst can be any suitable OPC catalyst, such as for example, iron oxide, bromine oxide, or combinations thereof.

A compressor discharge stream with compressed and cooled nitrogen refrigerant flows in a conduit 320 to the cold box 302 for cooling the hydrogen gas stream. After the cold box 302, the nitrogen refrigerant stream flows through a conduit 322 and is split between conduits 324 and 326. As an example, the refrigerant stream is split at a ratio of 1:1 or lower for the conduit 324 as compared to the conduit 326. A first stream portion in the conduit 324 is directed to an expander 306, which in turn drives a compressor 304. The combination of the expander 306 and the compressor 304 may also be referred to as an expander-compressor. The second stream portion in the conduit 326 is directed back through and out of the cold box 302 in a conduit 328 to an expander 308 which drives a compressor 310 (i.e., expander-compressor 308/310). It is noted that, unlike the first stream portion 324, the second stream portion in the conduit 326 is fed to the cold box 302 to thereby produce the stream in the conduit 328 which is fed to the expander 308. Consequently, a first expanded stream, or low pressure working fluid vapor, flows from the expander 306 in a conduit 330 and a second expanded stream, or low pressure working fluid vapor, flows from the expander 308 in a conduit 340, both to the cold box 302. The first expanded stream in the conduit 330 may be, for example, at −90° F. and the second expanded stream in the conduit 340 at, for example, a temperature of about −288° F. The first and second expanded streams are used in respective heat exchange stages to facilitate further cooling of the hydrogen gas in the cold box 302. The arrangement described can also be referred to as a twin expander-compressor assembly, used for compression of the nitrogen refrigerant used as the working fluid in the first stage cycle.

The refrigeration content of the second expanded stream in the conduit 340 is used for cooling hydrogen gas in the cold box 302 to produce a second warm nitrogen in a conduit 342 (or a warm intermediate stage working fluid vapor). The vapor stream is then compressed in the compressor 310 to produce a compressed stream in a conduit 344, which is further compressed in the compressor 304 to produce a compressed stream in a conduit 346 that is recycled back to the first stage refrigerant compressor 309 and second stage compressor 313. Conduits 344, 346, 303, 320 can also include air coolers 316, 318, 311, 315 to cool the compressed refrigerant streams further. Similarly, the refrigeration content of the first expanded stream in the conduit 330 is used for cooling hydrogen gas in the cold box 302 to produce a first warm refrigerant vapor (nitrogen) in a conduit 332 that is combined with stream 346 as common suction stream 303 and recycled back to the first stage nitrogen refrigerant compressor 309. Consequently, the warm nitrogen refrigerant vapor stream is the working fluid and provides refrigeration content in the cold box 302 for cooling hydrogen gas in the conduit 301. The first expanded nitrogen refrigerant stream in the conduit 330 may be at, for example, a pressure of about 160 psia, and the second expanded stream in the conduit 340 may be at, for example, a pressure of about 60 psia.

The cold hydrogen gas stream in the conduit 350 from the cold box 302 outlet is then routed to the second stage cryogenic heat exchanger cold box 325, wherein the refrigerant comprises a hydrogen+neon mixture ($H_2$—Ne) or hydrogen ($H_2$) or Helium (He) that can be used as working fluid for the hydrogen liquefaction and sub-cooling cycle.

In the second stage, the hydrogen gas stream in the conduit 350 can be further treated in the cryogenic heat exchanger cold box 325 pass/core, packed with OPC catalyst, to pre-convert hydrogen (50%) para to (100%) para-fraction near equilibrium in the cold hydrogen gas stream in the conduit 390 leaving the second cryogenic heat exchanger (cold box) 325. The OPC catalyst can be any suitable OPC catalyst, such as for example, iron oxide, bromine oxide, or combinations thereof.

A compressor discharge stream with compressed and cooled H2-Ne refrigerant flows in a conduit 360 to the cold box 325 for further cooling the hydrogen gas stream. After the cold box 325, the H2-Ne refrigerant stream flows through a conduit 361 and is split between conduits 362 and 363. The refrigerant stream is split, for example, at a ratio of 1:1 or lower for the conduit 362 as compared to the conduit 363. A first stream portion in the conduit 362 is directed to an expander 377 which in turn drives a compressor 375. The combination of 377, 375 may also be referred to as an expander-compressor. The second stream portion in the conduit 363 is directed back through and out of the cold box 325 in a conduit 365 to an expander 371 which drives a compressor 373 (i.e., expander-compressor 371/373). It is noted that, unlike the first stream portion 362, the second stream portion 363 is fed to the cold box 325 to thereby produce the stream 365 which is fed to the expander 371. Consequently, a first expanded stream, or low pressure working fluid vapor, flows from the expander 377 in a conduit 364 and a second expanded stream, or low pressure working fluid vapor, flows from the expander 371 in a conduit 366, both to the cold box 325. The first expanded stream in the conduit 364 may be at a temperature of about −360° F. and the second expanded stream in the conduit 366 may be at a temperature of about −410° F. and the first and second expanded streams are used in respective heat exchange stages to facilitate further cooling and liquefaction of the hydrogen gas in the cold box 325. The arrangement described can also be referred to as a twin expander-compressor assembly, used for compression of the H2-Ne refrigerant used as the working fluid in the second stage cooling.

The refrigeration content of the second expanded stream in the conduit 366 is used for cooling the hydrogen gas in the cold box 325 to produce a second warm H2-Ne refrigerant stream in a conduit 367 (or a warm intermediate stage working fluid vapor). The vapor stream in the conduit 367 is then compressed in the compressor 373 to produce a compressed stream in a conduit 368, which is further compressed in the compressor 375 to produce a compressed stream in a conduit 376 that is recycled back to the first stage refrigerant compressor 382 and second stage compressor 384. Conduits 368, 376, 352, 360 can also include air coolers 369, 374, 378, 380 to further cool the compressed refrigerant streams. Similarly, the refrigerant content of the first expanded stream in the conduit 364 is used for cooling the hydrogen gas in the cold box 325 to thereby produce a first warm refrigerant vapor ($H_2$—Ne) in a conduit 379 (or, a warm intermediate stage working fluid vapor) that is combined with the refrigerant stream in the conduit 376 as common suction stream of refrigerant in a conduit 352 and recycled back to the first stage $H_2$—Ne refrigerant compressor 382. Consequently, the warm refrigerant vapor ($H_2$—Ne) stream is the working fluid and provides refrigeration in the cold box 325 for cooling the hydrogen gas in the conduit 350. The first expanded stream in the conduit 364 may be, for example, at a pressure of about 85 psia, and the second expanded stream in the conduit 375 may be, for example, at a pressure of about 65 psia for H2-Ne refrigerant cycle.

LH2 from the second stage cold box 325 in conduit 390 is directed to another adiabatic ortho-para catalytic converter absorber vessel 305, to ensure full and complete conversion of normal hydrogen with 25% para to 100% para fraction and the outlet is routed to an expander or hydraulic turbine 358 to produce an expanded LH2 stream in a conduit 391. The LH2 stream may be expanded, for example, to about 14.5 psig (1 barg) pressure, and sub-cooled, for example, to −418° F. The LH2 is then stored in a pressurized storage tank 392 for later export in a conduit 400.

BOG output from the storage tank 392 in a conduit 393 is routed to the second stage cold box 325. The refrigeration content of the hydrogen vapor stream in the conduit 393 can be used to supplement the heat exchange in the second stage cold box 325, prior to recycling the stream back to the front-end hydrogen booster compressor 104 using a flash gas compressor 381 via conduits 394, 396, and 399. The compressed hydrogen vapor stream in the conduit 396 is cooled in air cooler 398 and recycled to the hydrogen feed booster compressor 104 through the conduit 399. Power for the compressor 381 may be provided by an electric motor 378, or any other suitable power source.

Figure 2:
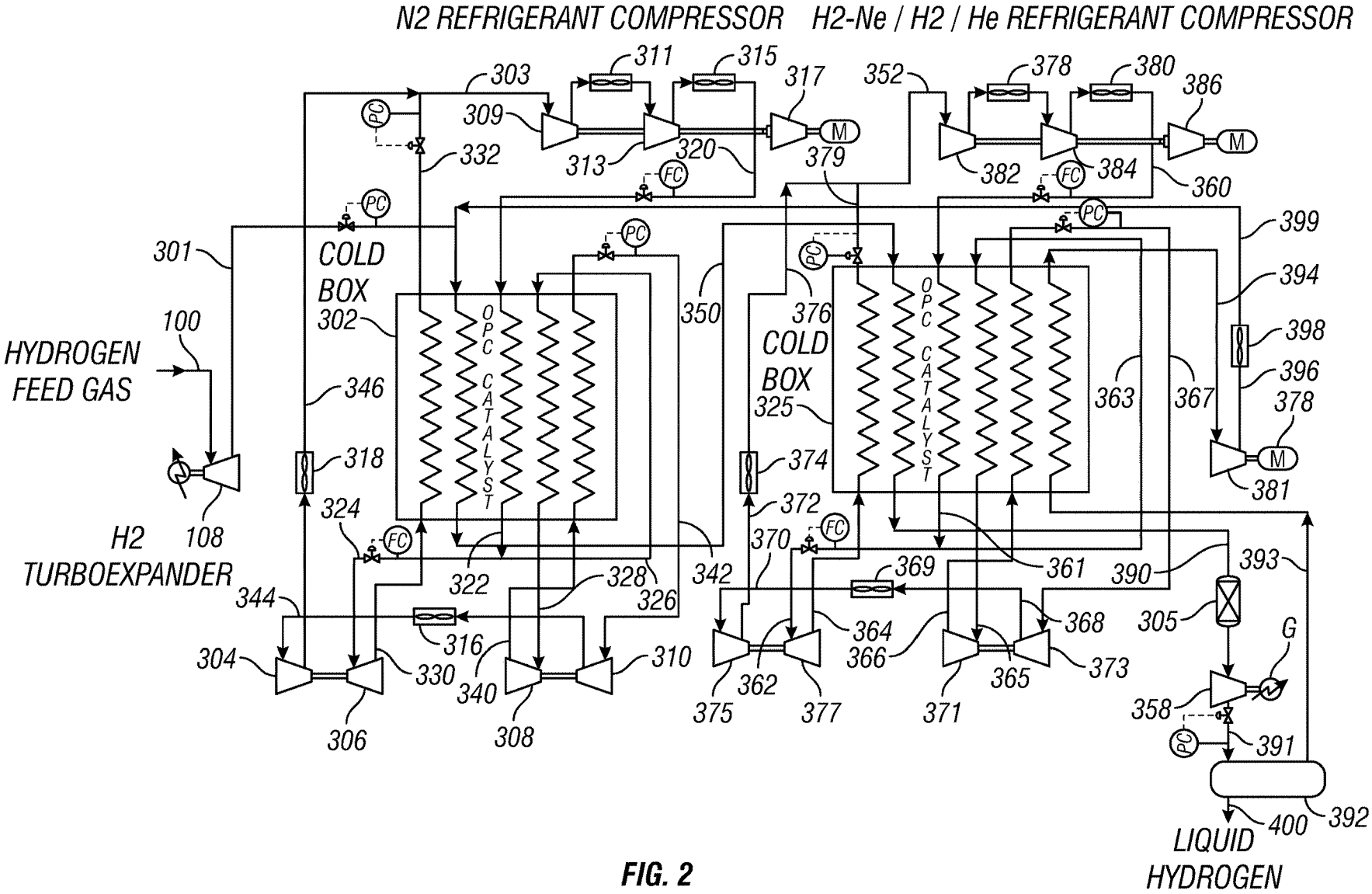
FIG. 2 is an equipment and process flow diagram for another embodiment of a hydrogen liquefaction plant or system in accordance with principles disclosed herein.

FIG. 2 illustrates another embodiment of a hydrogen liquefaction process, wherein the contemplated methods and configurations include similar first stage and second stage liquefaction and sub-cooling cycles as discussed above for the embodiment in FIG. 1. However, in the process of FIG. 2, the hydrogen feed gas stream in the conduit 100 is not fed through the booster compressors 104, 108. Instead, the hydrogen feed gas stream in the conduit 100 is fed to a turboexpander 108 to produce an expanded, lower pressure stream of hydrogen. The process of FIG. 2 may be used, for example, where the hydrogen storage pressure is higher than a desired liquefaction pressure. For example, if the hydrogen is fed from an underground storage at an elevated pressure, the initial booster compressors are not needed for increasing the pressure of the feed stream before entering the cold box 302. The remaining process and equipment shown in FIG. 2 is similar to the embodiment described above in FIG. 1 and the details will not be repeated.

Figure 3:
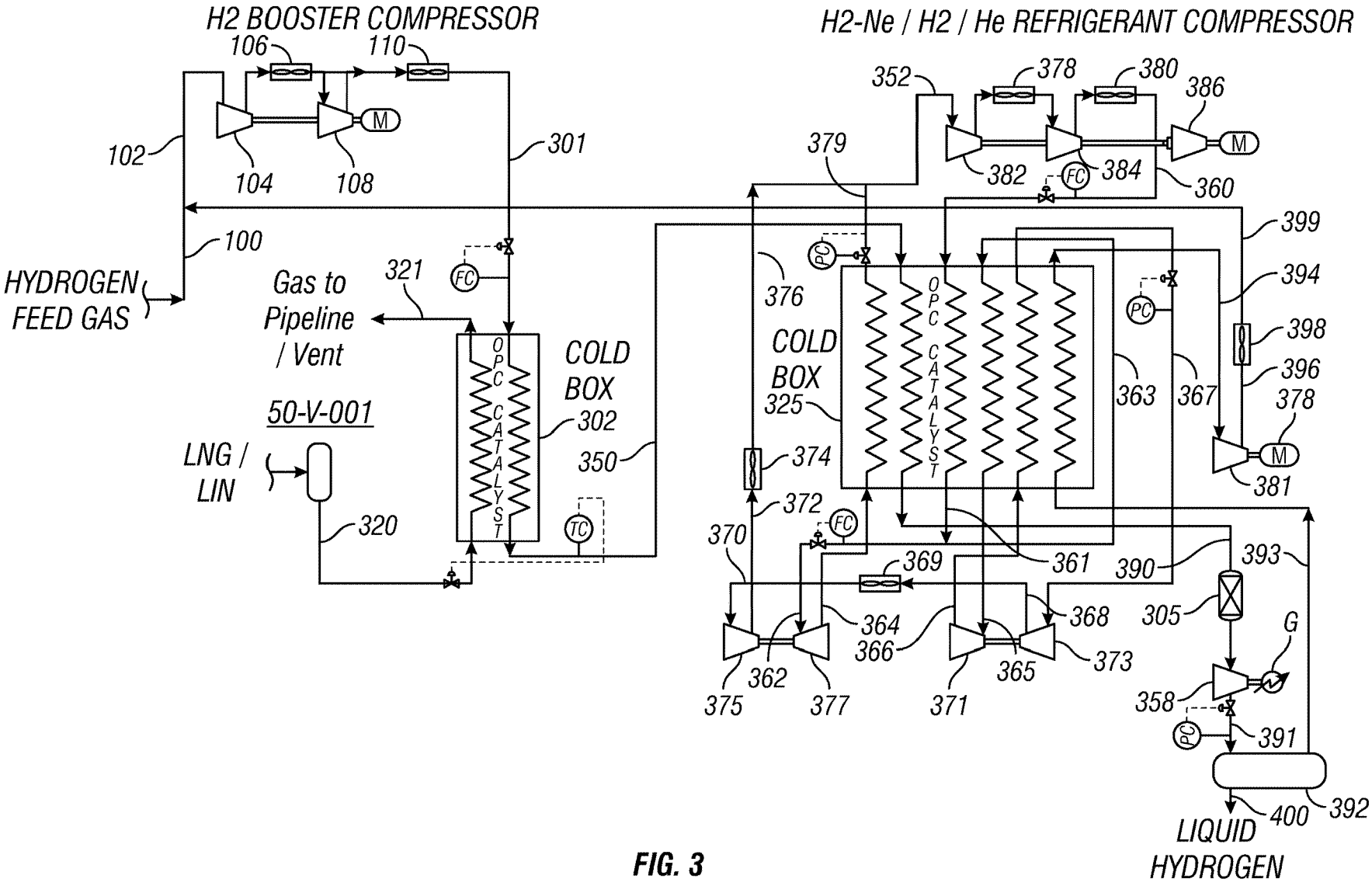
FIG. 3 is an equipment and process flow diagram for another embodiment of a hydrogen liquefaction plant or system in accordance with principles disclosed herein.

FIG. 3 illustrates another embodiment of a hydrogen liquefaction process, wherein the contemplated methods and configurations include a single refrigerant LIN or LNG for pre-cooling, followed by the second stage liquefaction and sub-cooling cycle using a refrigerant mixture in a closed-loop refrigeration cycle for a small and large scale hydrogen liquefier. The LIN/LNG refrigerant in conduit 320 cools the high pressure hydrogen feed gas stream in the conduit 301 to between about −285° F./−250° F., by vaporization in the pre-cooling exchanger cold box 302.

As with the process shown in FIG. 1, FIG. 3 illustrates a process that uses a hydrogen booster compressor, where a hydrogen gas feed stream in a conduit 100 and a BOG recycle stream in a conduit 399 combine into a conduit 102 before being fed to a booster compressor 104 and 108, which may be driven by an electric motor. The outlet gas stream may be cooled in air coolers 106 and 110, to produce cold high pressure gas stream 301 at appropriate conditions for entering the hydrogen liquefaction process first stage cryogenic heat exchanger (cold box) 302.

Unlike, the process shown in FIG. 1, in the pre-cooling exchanger cold box 302 of FIG. 3, a vapor nitrogen refrigerant stream in conduit 321 from the cold box 302 may be vented to atmosphere. In case of LNG stream used for pre-cooling, the refrigerant stream will normally be associated with the nearby LNG Regasification facilities, whereby the vaporized LNG can be supplied to the pipeline for distribution. For example, a liquid nitrogen ("LIN") stream available from an air separation unit ("ASU") or liquid natural gas ("LNG") available from a nearby LNG Import Terminal and Regasification facility, can be evaporated in the first stage cryogenic heat exchanger cold box 302 against the high pressure hydrogen gas, to provide additional cooling duty to pre-cool the high pressure hydrogen gas. The freely available cold duty from LIN/LNG stream, for instance, can reduce the overall cooling duty of the hydrogen liquefier by 30%, and thus the refrigerant mass flows, to be provided by twin expander-compressor hydrogen+neon/hydrogen/helium cycle.

The hydrogen gas stream in the conduit 301 is treated in the cryogenic heat exchanger cold box 302 pass/core, packed with OPC catalyst, to pre-convert normal-hydrogen (25%) para to a para-fraction near equilibrium in the cold hydrogen gas stream in a conduit 350, before routing to the second cryogenic heat exchanger (cold box) 325.

In the cryogenic heat exchanger 325, a refrigerant media comprising hydrogen+neon mixture ($H_2$—Ne) or hydrogen ($H_2$) or Helium (He) can be used as working fluid for hydrogen liquefaction and subcooling. A compressor discharge stream with compressed and cooled $H_2$—Ne refrigerant flows in a conduit 360 to the cold box 325 for further cooling of the hydrogen gas stream. After the cold box 325, the $H_2$—Ne refrigerant stream flows through a conduit 361 and is split between conduits 362 and 363. The refrigerant stream may be split, for example, at a ratio of 1:1 or lower for the conduit 362 as compared to the conduit 363. A first stream portion in the conduit 362 is directed to an expander 377 which in turn drives a compressor 375. The combination of 377, 375 may also be referred to as an expander-compressor. The second stream portion in the conduit 363 is directed back through and out of the cold box 325 in a conduit 365 to an expander 371 which drives a compressor 373 (i.e., expander-compressor 371/373). It is noted that, unlike the first stream portion 362, the second stream portion 363 is fed to the cold box 325 to thereby produce the stream 365 which is fed to the expander 371. Consequently, a first expanded stream, or low pressure working fluid vapor, flows from the expander 377 in a conduit 364 and a second expanded stream, or low pressure working fluid vapor, flows from the expander 371 in a conduit 366, both to the cold box 325. The first expanded stream 364 may be at, or example, a temperature of about −360° F. and second expanded stream 375 may be at, for example, a temperature of about −410° F. The first and second expanded streams are used in respective heat exchange stages to facilitate further cooling an liquefaction of hydrogen gas in the cold box 325. The arrangement described can also be referred to as a twin expander-compressor assembly, used for compression of the $H_2$—Ne refrigerant used as the working fluid in the second stage cooling.

The refrigeration content of the second expanded stream in the conduit 366 is used for cooling hydrogen gas in the cold box 325 to produce a second warm $H_2$—Ne refrigerant in a conduit 367 (or a warm intermediate stage working fluid vapor). The vapor stream in the conduit 367 is then compressed in the compressor 373 to produce a compressed stream in a conduit 368, which is further compressed in the compressor 375 to produce a compressed stream in a conduit 376 that is recycled back to the first stage refrigerant compressor 382 and second stage compressor 384. Conduits 368, 376, 352, 360 can also include air coolers 369, 374, 378, 380 to further cool the compressed refrigerant streams. Similarly, the refrigeration content of the first expanded stream in the conduit 364 is used for cooling hydrogen gas in the cold box 325 to produce a first warm refrigerant vapor ($H_2$—Ne) in a conduit 379 (or, a warm intermediate stage working fluid vapor) that is combined with the refrigerant stream in the conduit 376 as a common suction stream in a conduit 352 and recycled back to the first stage $H_2$—Ne refrigerant compressor 382. Consequently, the warm refrigerant vapor ($H_2$—Ne) stream is the working fluid and provides refrigeration content in the cold box 325 for cooling hydrogen gas in. The first expanded stream in the conduit 364 may be, for example, at a pressure of about 80 psia, and the second expanded stream in the conduit 366 may be, for example, at a pressure of about 60 psia for $H_2$—Ne refrigerant cycle.

The hydrogen gas stream treated in the cryogenic heat exchanger cold box 302 pass/core, which may be packed with OPC catalyst to pre-convert normal-hydrogen (25%) para to a para-fraction near equilibrium in the cold hydrogen gas stream 350, before routing the hydrogen back to the second cryogenic heat exchanger (cold box) 325. wherein the refrigerant media hydrogen+neon mixture ($H_2$—Ne) or hydrogen ($H_2$) or Helium (He) can be used as working fluid for hydrogen liquefaction and subcooling.

LH2 from the second stage cold box 325 in the conduit 390 is directed to an adiabatic ortho-para catalytic converter absorber vessel 305 and the outlet is routed an expander or hydraulic turbine 358 to produce an expanded LH2 stream in a conduit 391. The LH2 stream may be expanded, for example, to about 14.5 psig (1 barg) pressure, and sub-cooled, for example, to about −418° F. The LH2 is then stored in a pressurized storage tank 392, for later export in a conduit 400.

BOG from the storage tank 392 in a conduit 393 is routed to the second stage cold box 325. The refrigeration content of the hydrogen vapor stream in the conduit 393 can be used to supplement the heat exchange in the second stage cold box 325, prior to recycling the stream back to the front end hydrogen booster compressor 104 by using flash gas compressor 381 via conduits 394, 396, 399. The compressed hydrogen vapor stream in the conduit 396 is cooled in air cooler 398 and recycled to the hydrogen feed booster compressor 104 through the conduit 399. Power for the compressor 381 may be provided by an electric motor 378 or any other suitable power source.

FIG. 4 shows a table showing a comparison of example previous hydrogen liquefaction processes with the processes shown in FIGS. 1-3. In each of the examples shown, the type of pre-cooling cycle (if any) and the liquefaction and sub-cooling cycles are listed. The SEC and EXE for each example are also listed. For each example, the hydrogen plant feed gas and liquefaction pressures are 1160 psi (80 barg) and the hydrogen storage pressure is 14.5 psi (1.0 barg).

FIG. 5 is a table showing operating and performance parameters of the hydrogen liquefaction processes of FIGS. 1-3. The different processes shown are different processes such as: Twin Expander Nitrogen–Hydrogen+Neon/Hydrogen/Helium Cycle and Nitrogen/LNG Pre-cooled Twin Expander Hydrogen+Neon Cycle for hydrogen liquefaction processes. Also shown are the optimum proprietary selection of the minimum number of stages of turbo-machinery, refrigerant media, operating conditions (temperature & pressure) for the processes that provide the lowest possible specific energy consumption of 5.2 kW/kg LH2 which is significantly lower, 30-40%, in comparison with other known liquefaction technologies. The operating and performance parameters are for systems operating at an average ambient temperature of 77° F./25° C. As used in the table, PTEXP-$N_2$/$H_2$+Ne is the pre-cooled twin compressor-expander process using a refrigerant comprising nitrogen and hydrogen+neon as shown in FIG. 2. TEXP-$N_2$/$H_2$+Ne is the twin compressor-expander process using a refrigerant comprising nitrogen-hydrogen+neon in the refrigeration cycles as shown in FIG. 1. TEXP-$N_2$—$H_2$ is the twin compressor-expander process using a refrigerant comprising nitrogen-hydrogen in the refrigeration cycles as shown in FIG. 1. TEXP-$N_2$—He is the twin compressor-expander process using a refrigerant comprising nitrogen-helium in the refrigeration cycles as shown in FIG. 1. PLNG-LIN/TEXP $H_2$+Ne is the pre-cooled LNG/LIN twin compressor-expander process using a refrigerant comprising hydrogen+neon in the refrigeration cycles as show in FIG. 3. Also, the power consumption/generation by the hydrogen feed gas booster compressor/expander is not included in the parameters.

Figure 6:
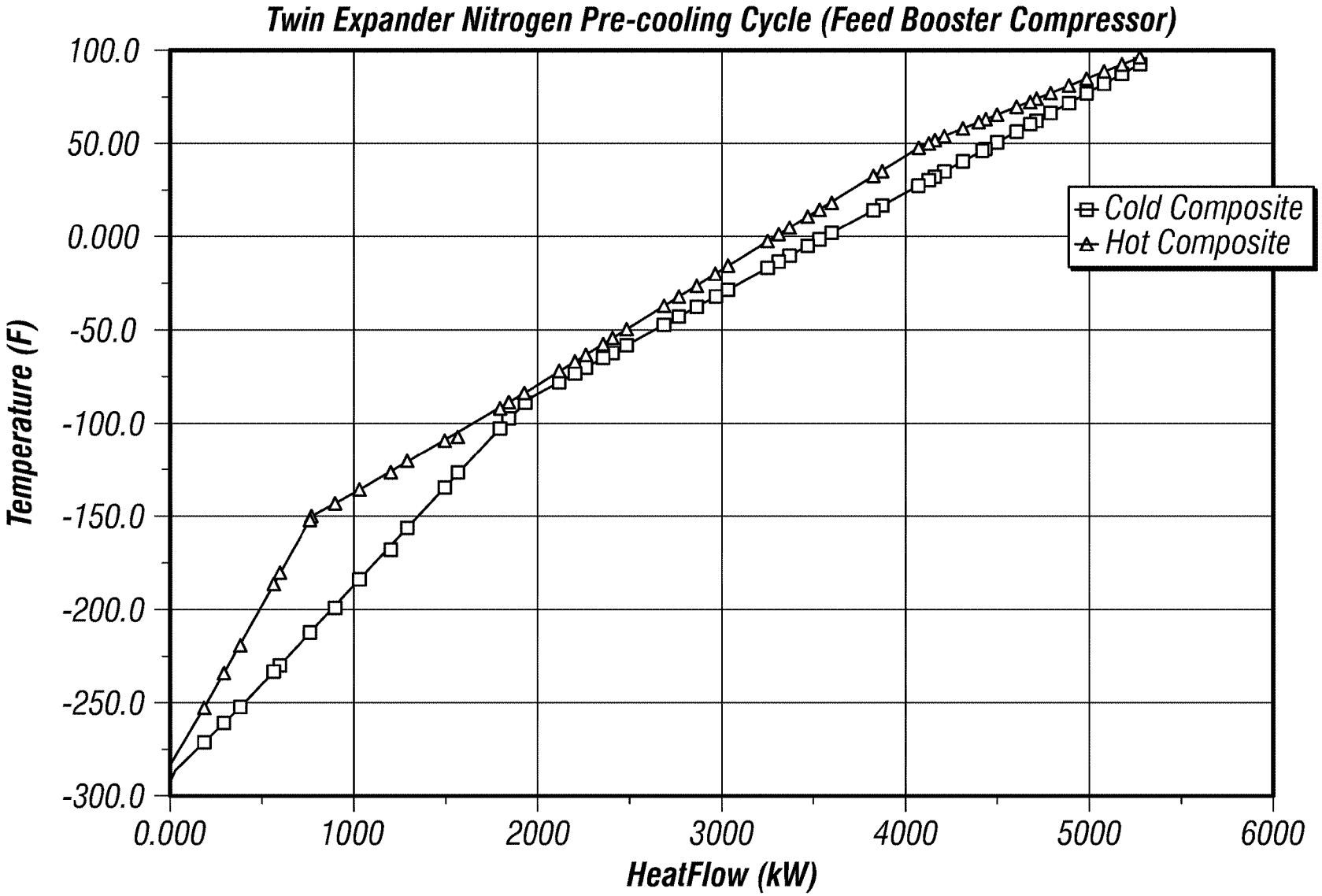
FIG. 6 is a graph showing composite heat curves between hydrogen and refrigerant, nitrogen for initial 1st stage pre-cooling cycle cryogenic exchanger cold box with a feed booster compressor process shown in FIG. 1.

FIG. 6 is a graph that shows a cold composite heat curve for the LIN pre-cooled twin compressor-expander cycle with a feed booster compressor process shown in FIG. 1 and a hot composite heat curve for hydrogen, that can be closely matched to reduce energy consumption, using heat flow (btu/hr) as a function of temperature (° F.).

Figure 7:
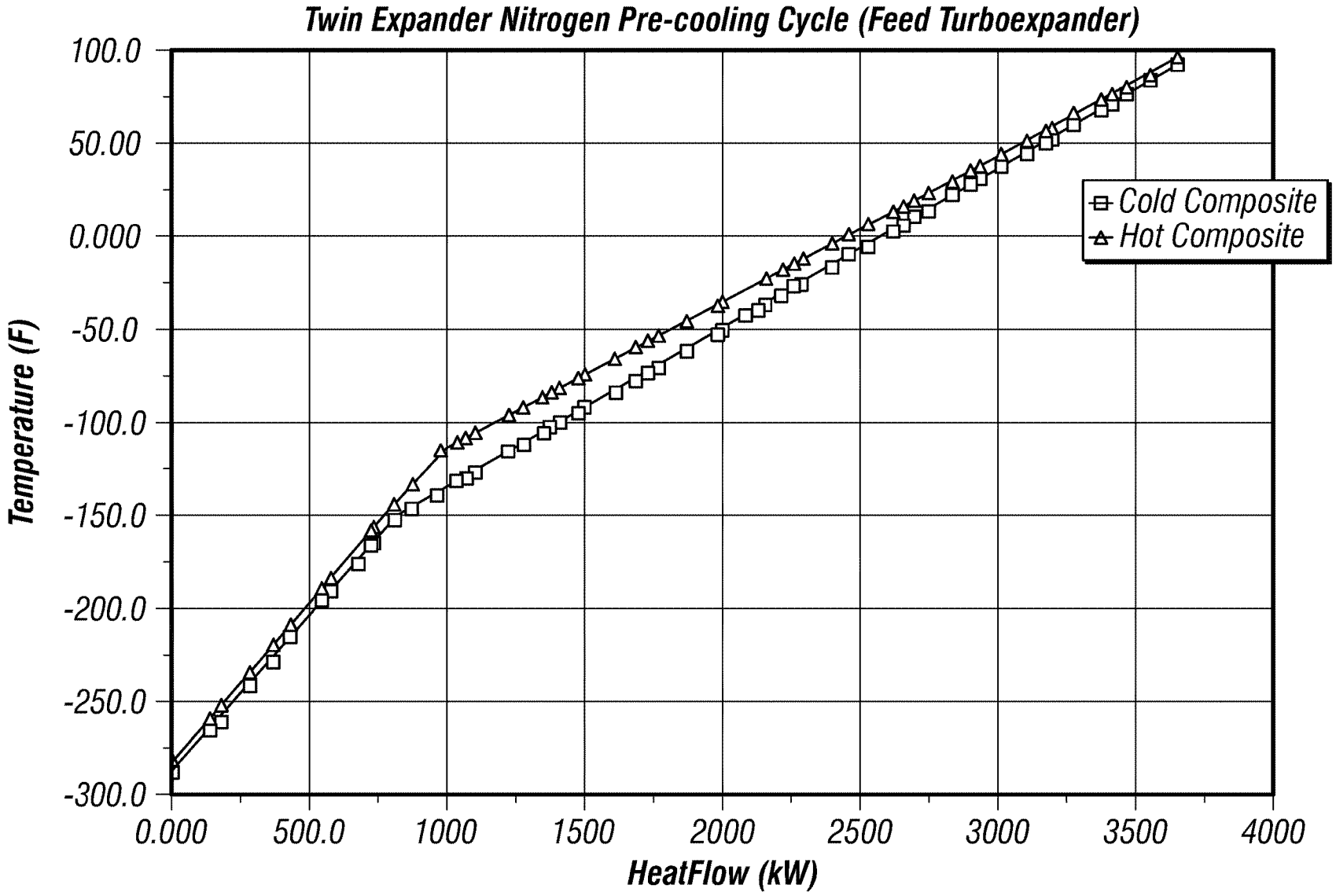
FIG. 7 is a graph showing composite heat curves between hydrogen and refrigerant, nitrogen for initial 1st stage pre-cooling cycle cryogenic exchanger cold box with a feed turboexpander process shown in FIG. 2.

FIG. 7 is a graph that shows a cold composite heat curve for the pre-cooled twin compressor-expander cycle with a feed turboexpander process shown in FIG. 2 and a hot composite heat curve for hydrogen, that can be closely matched to reduce energy consumption, using heat flow (btu/hr) as a function of temperature (° F.).

Figure 8:
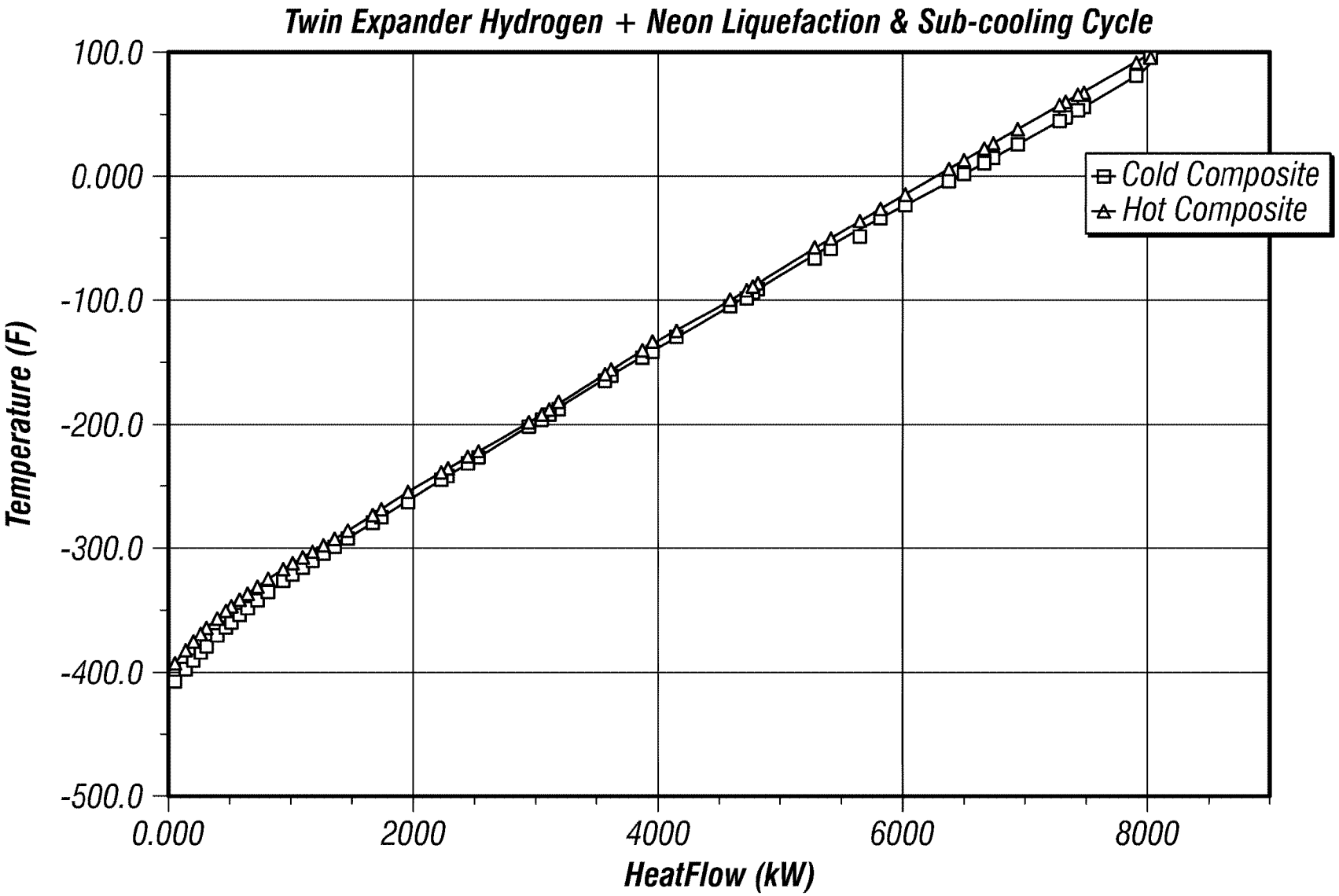
FIG. 8 is a graph showing the composite heat curves between hydrogen and refrigerants, hydrogen+neon cycle for $2^{nd}$ stage liquefaction and subcooling cycle cryogenic exchanger cold box process shown in FIGS. 1, 2 &3.

FIG. 8 is a graph that shows a cold composite heat curve for the second stage liquefaction and sub-cooling twin expander hydrogen+neon cycle working fluid process shown in FIGS. 1, 2 &3 and a hot composite heat curve for hydrogen, that can be closely matched to reduce energy consumption, using heat flow (btu/hr) as a function of temperature (° F.). Cold composite heat curves for Hydrogen and Helium working fluid similarly match very closely and is not included.

The refrigerant working fluid compositions and temperatures are also dependent on the operating pressures. As described herein, multiple stages of compression will narrow the temperature gaps between the refrigerant working fluid and hydrogen, reducing loss work and increasing liquefaction efficiency.

In various embodiments described herein, LH2 can be produced at a rate of 10-200 tons per day (tpd) or higher for a single hydrogen liquefaction train.

The contemplated process described above, offers the lowest possible specific energy consumption of 5.2 kW/kg LH2, which is significantly lower, 30-40%, in comparison with previous hydrogen liquefaction technologies, as demonstrated by the hydrogen liquefaction & refrigerant summaries in FIGS. 4 and 5 and the composite heat curves shown in FIGS. 6, 7, and 8.

Having described various devices and methods herein, exemplary embodiments or aspects can include, but are not limited to the following additional embodiments:

A system for providing hydrogen gas feed stream to a liquefaction plant may comprise a compressor configured to receive a first hydrogen gas stream at a first pressure and produce a second hydrogen gas stream at a second pressure; an exchanger, wherein the exchanger is configured to receive the second hydrogen gas stream as the second pressure and cool the second hydrogen gas stream to produce a cooled hydrogen gas stream.

The system of the first embodiment, wherein the exchanger is an ambient air exchanger configured to exchange heat between the second hydrogen gas stream at the second pressure and an ambient air stream.

A system for providing hydrogen gas feed stream to a liquefaction plant may comprise a turbo expander configured to receive a first hydrogen gas stream at a high pressure from underground hydrogen storage cavers and produce a second pre-cooled hydrogen gas stream at a second pressure required for the hydrogen liquefaction facility.

A single refrigerant or a refrigerant mixture for the first and second stage closed loop refrigeration cycle for small and large-scale hydrogen liquefiers. The contemplated hydrogen liquefaction processes are optimized in terms of plant energy efficiency and total costs, while reducing the total number of turbo machinery and other process equipment as well as the plant operational complexity and capital costs. Plant availability and maintainability has been increased. Compared to previous technology for cold refrigeration cycles in large-scale hydrogen liquefaction plants, the embodiments can reduce SEC by as much as 30-40%, thus enabling an economical production of liquid hydrogen on a large-scale for clean energy applications.

A liquid turbo-expander allowing a two-phase discharge, the subcooled hydrogen product stream can be directly expanded into the two-phase region to the final product storage pressure of 14.5 psig (1 barg).

A single refrigerant LIN/LNG for pre-cooling, followed by liquefaction and sub-cooling using a refrigerant mixture in a closed-loop refrigeration cycle for a small and large-scale hydrogen liquefier.

In various embodiments described herein, LH2 can be produced at a rate of 10 to 300 tpd.

Examples of the above embodiments include the following numbered examples:

Example 1. A method of liquefying a gaseous hydrogen comprising:

flowing the gaseous hydrogen through a first refrigeration stage comprising a first refrigerant flowing through a first heat exchanger in a first refrigerant stream to cool the gaseous hydrogen;

flowing the cooled gaseous hydrogen through a second refrigeration stage comprising:

flowing a second refrigerant in a second refrigerant stream through a second heat exchanger;

splitting the second refrigerant stream into a first split second refrigerant stream and a second split second refrigerant stream;

expanding the first split second refrigerant stream in a first compressor-expander and flowing the expanded first split second refrigerant stream back through the second heat exchanger;

flowing the second split second refrigerant stream back through the second heat exchanger;

expanding the second split second refrigerant stream in a second compressor-expander and flowing the expanded second split second refrigerant stream back through the second heat exchanger;

compressing the second split second refrigerant stream in the first compressor-expander and then the second compressor-expander; and cooling the gaseous hydrogen in the second refrigeration stage to produce a liquefied hydrogen.

Example 2. The method of Example 1, wherein flowing the second refrigerant through the second refrigeration circuit further comprises combining the first and second split second refrigerant streams and compressing the combined first and second split second refrigerant streams for flowing back to the second heat exchanger to complete the second refrigeration stage.

Example 3. The method of Example 1, wherein flowing the gaseous hydrogen through the second heat exchanger further comprises flowing the gaseous hydrogen through an ortho-para conversion (OPC) catalyst in the second heat exchanger.

Example 4. The method of Example 1, comprising flowing the liquefied hydrogen through an adiabatic orth-para catalytic converter absorber vessel.

Example 5. The method of Example 4, further comprising expanding the liquefied hydrogen by flowing the liquefied hydrogen through an expander.

Example 6. The method of Example 1, further comprising cooling the second refrigerant with one or more air coolers in the second refrigeration stage.

Example 7. The method of Example 1, wherein splitting the second refrigerant stream into a first split second refrigerant stream and a second split second refrigerant stream comprises splitting the second refrigerant stream at a ratio of 1:1 or lower for the first split second refrigerant stream.

Example 8. The method of Example 1, further comprising:

storing the liquefied hydrogen from the second refrigeration stage in a storage tank;

outputting boil off gaseous (BOG) hydrogen from the storage tank and flowing the BOG hydrogen through the second heat exchanger;

compressing the BOG hydrogen; and combining the compressed BOG hydrogen with the gaseous hydrogen for flowing through the first heat exchanger.

Example 9. The method of Example 1, wherein the second refrigerant comprises hydrogen and neon, hydrogen, or helium.

Example 10. The method of Example 1, wherein flowing the gaseous hydrogen through the first refrigeration stage further comprises:

flowing the first refrigerant in the first refrigerant stream through the first heat exchanger;

splitting the first refrigerant stream into a first split first refrigerant stream and a second split first refrigerant stream;

expanding the first split first refrigerant stream in a third compressor-expander and flowing the expanded first split first refrigerant stream back through the first heat exchanger;

flowing the second split first refrigerant stream back through the first heat exchanger;

expanding the second split first refrigerant stream in a fourth compressor-expander and flowing the expanded second split first refrigerant stream back through the first heat exchanger; and compressing the second split first refrigerant stream in the third compressor-expander and then the fourth compressor-expander;

cooling the gaseous hydrogen in the first refrigeration stage before flowing to the second heat exchanger.

Example 11. The method of Example 10, wherein flowing the first refrigerant through the first refrigeration stage further comprises combining the first and second split first refrigerant streams and compressing the combined first and second split first refrigerant streams for flowing back to the first heat exchanger.

Example 12. The method of Example 10, wherein flowing the gaseous hydrogen through the first heat exchanger further comprises flowing the gaseous hydrogen through an OPC catalyst in the first heat exchanger.

Example 13. The method of Example 10, further comprising compressing the gaseous hydrogen before flowing the gaseous hydrogen through the first heat exchanger.

Example 14. The method of Example 10, further comprising expanding the gaseous hydrogen before flowing the gaseous hydrogen through the first heat exchanger.

Example 15. The method of Example 10, wherein the first refrigerant comprises nitrogen.

Example 16. The method of Example 10, wherein splitting the first refrigerant stream into a first split first refrigerant stream and a second split first refrigerant stream comprises splitting the first refrigerant stream at a ratio of 1:1 or lower for the first split second refrigerant stream.

Example 17. The method of Example 1, wherein flowing the gaseous hydrogen through the first heat exchanger further comprises flowing the gaseous hydrogen through an OPC catalyst in the second heat exchanger.

Example 18. The method of Example 1, further comprising compressing the gaseous hydrogen before flowing the gaseous hydrogen through the first heat exchanger.

Example 19. The method of Example 1, wherein the first refrigerant comprises liquefied natural gas, liquefied nitrogen, or a combination thereof.

Example 20. A system for liquefying a gaseous hydrogen comprising:

a first refrigeration stage comprising a first heat exchanger configured to flow a first refrigerant in a first refrigerant stream through the first heat exchanger to cool the gaseous hydrogen;

a second refrigeration stage comprising:

a second heat exchanger configured to flow a second refrigerant in a second refrigerant stream through the second heat exchanger;

wherein the second refrigerant stream is split into a first split second refrigerant stream and a second split second refrigerant stream after flowing through the second heat exchanger;

a first compressor-expander operable to expand the first split second refrigerant stream and wherein the second heat exchanger is configured to flow the expanded first split second refrigerant stream back through the second heat exchanger;

wherein the second heat exchanger is configured to flow the second split second refrigerant stream back through the second heat exchanger;

a second compressor-expander operable to expand the second split second refrigerant stream and wherein the second heat exchanger is configured to flow the expanded second split second refrigerant stream back through the second heat exchanger;

wherein the first compressor-expander is operable to compress the second split second refrigerant stream and wherein the second compressor-expander is operable to further compress the second split second refrigerant stream from the first compressor-expander; and wherein the second refrigeration stage is configured to cool the gaseous hydrogen to produce a liquefied hydrogen.

Example 21. The system of Example 20, wherein the first and second split second refrigerant streams are combined and compressed before flowing back to the second heat exchanger.

Example 22. The system of Example 20, wherein the second heat exchanger further comprises an ortho-para conversion (OPC) catalyst and is configured to flow the gaseous hydrogen through the OPC catalyst.

Example 23. The system of Example 20, further comprising an adiabatic orth-para catalytic converter absorber vessel configured to receive the liquefied hydrogen after the second refrigeration stage.

Example 24. The system of Example 23, further comprising an expander operable to expand the liquefied hydrogen.

Example 25. The system of Example 20, wherein the second refrigerant stream is split at a ratio of 1:1 or lower for the first split second refrigerant stream.

Example 26. The system of Example 20, further comprising:

a storage tank configured to store the liquefied hydrogen from the second refrigeration stage; and a compressor operable to compress boil off gaseous (BOG) hydrogen from the storage tank and flowing the BOG hydrogen through the second heat exchanger;

wherein the second heat exchanger is configured to flow the compressed BOG hydrogen through the second heat exchanger; and wherein the compressed BOG hydrogen is combined with the gaseous hydrogen for flowing through the first heat exchanger.

Example 27. The system of Example 20, wherein the second refrigerant comprises hydrogen and neon, hydrogen, or helium.

Example 28. The system of Example 20, wherein the first refrigeration stage further comprises:

wherein the first refrigerant stream is split into a first split first refrigerant stream and a second split first refrigerant stream after flowing through the first heat exchanger;

a third compressor-expander operable to expand the first split first refrigerant stream and wherein the first heat exchanger is configured to flow the expanded first split first refrigerant stream back through the first heat exchanger;

wherein the first heat exchanger is configured to flow the second split first refrigerant stream back through the first heat exchanger;

a fourth compressor-expander operable to expand the second split first refrigerant stream and wherein the first heat exchanger is configured to flow the expanded second split first refrigerant stream back through the first heat exchanger; and wherein the third compressor-expander is operable to compress the second split first refrigerant stream and wherein the fourth compressor-expander is operable to further compress the second split first refrigerant stream from the third compressor-expander.

Example 29. The system of Example 28, wherein the first and second split first refrigerant streams are combined and compressed before flowing back to the first heat exchanger.

Example 30. The system of Example 28, wherein the first heat exchanger further comprises an ortho-para conversion (OPC) catalyst and is configured to flow the gaseous hydrogen through the OPC catalyst.

Example 31. The system of Example 28, further comprising a compressor operable to compress the gaseous hydrogen before flowing the gaseous hydrogen through the first heat exchanger.

Example 32. The system of Example 28, further comprising an expander operable to expand the gaseous hydrogen before flowing the gaseous hydrogen through the first heat exchanger.

Example 33. The system of Example 28, wherein the first refrigerant comprises nitrogen.

Example 34. The system of Example 28, wherein the first refrigerant stream is split at a ratio of 1:1 or lower for the first split first refrigerant stream.

Example 35. The system of Example 20, wherein the first heat exchanger further comprises an ortho-para conversion (OPC) catalyst and is configured to flow the gaseous hydrogen through the OPC catalyst.

Example 36. The system of Example 20, further comprising a compressor operable to compress the gaseous hydrogen before flowing the gaseous hydrogen through the first heat exchanger.

Example 37. The system of Example 20, wherein the first refrigerant comprises liquefied natural gas, liquefied nitrogen, or a combination thereof.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only and are not limiting. Accordingly, the scope of protection is not limited by the description set out above, but is only limited by the claims which follow, that scope including all equivalents of the subject matter of the claims.

Additionally, the section headings used herein are provided for consistency with the suggestions under 37 C.F.R. § 1.77 or to otherwise provide organizational cues. These headings shall not limit or characterize the invention(s) set out in any claims that may issue from this disclosure. Specifically, and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of" Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only and are not limiting. Accordingly, the scope of protection is not limited by the description set out above, but is only limited by the claims which follow, that scope including all equivalents of the subject matter of the claims.

While compositions and methods are described herein in terms of "comprising" various components or steps, the compositions and methods can also "consist essentially of" or "consist of" the various components and steps. Unless otherwise specified, in the discussion and in the claims, the terms "including" and "comprising" are used in an open-ended fashion, and thus should be interpreted to mean "including, but not limited to . . . ". Any use of any form of the terms "connect," "engage," "couple," "attach," or any other term describing an interaction between elements is not meant to limit the interaction to direct interaction between the elements and may include indirect interaction between the elements described. The various characteristics mentioned above, as well as other features and characteristics described in more detail below, will be readily apparent to those skilled in the art upon reading the detailed description of the embodiments, and by referring to the accompanying drawings.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques accepted by those skilled in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of liquefying a gaseous hydrogen comprising:

flowing the gaseous hydrogen through a first refrigeration stage comprising a first refrigerant flowing through a first heat exchanger in a first refrigerant stream to cool the gaseous hydrogen;

flowing the cooled gaseous hydrogen through a second refrigeration stage comprising:

flowing a second refrigerant in a second refrigerant stream through a second heat exchanger;

splitting the second refrigerant stream into a first split second refrigerant stream and a second split second refrigerant stream;

expanding the first split second refrigerant stream in a first compressor-expander and flowing the expanded first split second refrigerant stream back through the second heat exchanger;

flowing the second split second refrigerant stream back through the second heat exchanger;

expanding the second split second refrigerant stream in a second compressor-expander and flowing the expanded second split second refrigerant stream back through the second heat exchanger;

compressing the expanded second split second refrigerant stream in the second compressor-expander and then in the first compressor-expander; and cooling the gaseous hydrogen in the second refrigeration stage to produce a liquefied hydrogen.

2. The method of claim 1, wherein the flowing the second refrigerant through the second refrigeration stage further comprises combining the first and second split second refrigerant streams and compressing the combined first and second split second refrigerant streams for flowing back to the second heat exchanger to complete the second refrigeration stage.

3. The method of claim 1, wherein the flowing the gaseous hydrogen through the second heat exchanger further comprises flowing the gaseous hydrogen through an ortho-para conversion (OPC) catalyst in the second heat exchanger.

4. The method of claim 1, comprising flowing the liquefied hydrogen through an adiabatic ortho-para catalytic converter absorber vessel.

5. The method of claim 4, further comprising expanding the liquefied hydrogen by flowing the liquefied hydrogen through an expander.

6. The method of claim 1, wherein the splitting the second refrigerant stream into the first split second refrigerant stream and the second split second refrigerant stream comprises splitting the second refrigerant stream into two conduits at a ratio of 1:1 or lower for one of the conduits as compared to the other conduit.

7. The method of claim 1, further comprising:

storing the liquefied hydrogen from the second refrigeration stage in a storage tank;

outputting boil off gaseous (BOG) hydrogen from the storage tank and flowing the BOG hydrogen through the second heat exchanger;

compressing the BOG hydrogen; and combining the compressed BOG hydrogen with the gaseous hydrogen for flowing through the first heat exchanger.

8. The method of claim 1, wherein the second refrigerant comprises hydrogen and neon, hydrogen, or helium.

9. The method of claim 1, wherein the flowing the gaseous hydrogen through the first refrigeration stage further comprises:

splitting the first refrigerant stream into a first split first refrigerant stream and a second split first refrigerant stream;

expanding the first split first refrigerant stream in a third compressor-expander and flowing the expanded first split first refrigerant stream back through the first heat exchanger;

flowing the second split first refrigerant stream back through the first heat exchanger;

expanding the second split first refrigerant stream in a fourth compressor-expander and flowing the expanded second split first refrigerant stream back through the first heat exchanger; and compressing the expanded second split first refrigerant stream in the fourth compressor-expander and then in the third compressor-expander.

10. The method of claim 9, wherein the flowing the first refrigerant through the first refrigeration stage further comprises combining the first and second split first refrigerant streams and compressing the combined first and second split first refrigerant streams for flowing back to the first heat exchanger.

11. The method of claim 9, wherein the flowing the gaseous hydrogen through the first heat exchanger further comprises flowing the gaseous hydrogen through an OPC catalyst in the first heat exchanger.

12. The method of claim 9, further comprising compressing the gaseous hydrogen before flowing the gaseous hydrogen through the first heat exchanger.

13. The method of claim 9, further comprising expanding the gaseous hydrogen before flowing the gaseous hydrogen through the first heat exchanger.

14. The method of claim 9, wherein the first refrigerant comprises nitrogen.

15. The method of claim 9, wherein the splitting the first refrigerant stream into the first split first refrigerant stream and the second split first refrigerant stream comprises splitting the first refrigerant stream into two conduits at a ratio of 1:1 or lower for one of the conduits as compared to the other conduit.

16. The method of claim 1, further comprising compressing the gaseous hydrogen before flowing the gaseous hydrogen through the first heat exchanger.

17. A system for liquefying a gaseous hydrogen comprising:

a first refrigeration stage comprising a first heat exchanger configured to flow a first refrigerant in a first refrigerant stream through the first heat exchanger to cool the gaseous hydrogen;

a second refrigeration stage comprising:

a second heat exchanger configured to flow a second refrigerant in a second refrigerant stream through the second heat exchanger;

wherein the second refrigerant stream is split into a first split second refrigerant stream in a first conduit and a second split second refrigerant stream in a second conduit after flowing through the second heat exchanger;

a first compressor-expander operable to expand the first split second refrigerant stream and wherein the second heat exchanger is configured to flow the expanded first split second refrigerant stream back through the second heat exchanger;

wherein the second heat exchanger is configured to flow the second split second refrigerant stream back through the second heat exchanger;

a second compressor-expander operable to expand the second split second refrigerant stream and wherein the second heat exchanger is configured to flow the expanded second split second refrigerant stream back through the second heat exchanger;

wherein the second compressor-expander is operable to compress the expanded second split second refrigerant stream and wherein the first compressor-expander is operable to further compress the expanded second split second refrigerant stream from the second compressor-expander; and wherein the second refrigeration stage is configured to cool the gaseous hydrogen to produce a liquefied hydrogen.

18. The system of claim 17, wherein the first and second split second refrigerant streams are combined into a first common suction stream conduit and compressed by a first compressor before flowing back to the second heat exchanger.

19. The system of claim 17, wherein the second heat exchanger further comprises an ortho-para conversion (OPC) catalyst and is configured to flow the gaseous hydrogen through the OPC catalyst.

20. The system of claim 17, further comprising an adiabatic orth-para catalytic converter absorber vessel configured to receive the liquefied hydrogen after the second refrigeration stage.

21. The system of claim 20, further comprising an expander operable to expand the liquefied hydrogen.

22. The system of claim 17, wherein the second refrigerant stream is split at a ratio of 1:1 or lower for the first conduit as compared to the second conduit.

23. The system of claim 17, further comprising:

a storage tank configured to store the liquefied hydrogen from the second refrigeration stage; and a boil off gaseous (BOG) compressor operable to compress BOG hydrogen from the storage tank and flowing the BOG hydrogen through the second heat exchanger;

wherein the second heat exchanger is configured to flow the compressed BOG hydrogen through the second heat exchanger; and wherein the compressed BOG hydrogen is combined with the gaseous hydrogen in a third conduit for flowing through the first heat exchanger.

24. The system of claim 17, wherein the second refrigerant comprises hydrogen and neon, hydrogen, or helium.

25. The system of claim 17, wherein the first refrigeration stage further comprises:

wherein the first refrigerant stream is split into a first split first refrigerant stream in a fourth conduit and a second split first refrigerant stream in a fifth conduit after flowing through the first heat exchanger;

a third compressor-expander operable to expand the first split first refrigerant stream and wherein the first heat exchanger is configured to flow the expanded first split first refrigerant stream back through the first heat exchanger;

wherein the first heat exchanger is configured to flow the second split first refrigerant stream back through the first heat exchanger;

a fourth compressor-expander operable to expand the second split first refrigerant stream and wherein the first heat exchanger is configured to flow the expanded second split first refrigerant stream back through the first heat exchanger; and wherein the fourth compressor-expander is operable to compress the expanded second split first refrigerant stream and wherein the third compressor-expander is operable to further compress the expanded second split first refrigerant stream from the fourth compressor-expander.

26. The system of claim 25, wherein the first and second split first refrigerant streams are combined into a second common suction stream conduit and compressed by a second compressor before flowing back to the first heat exchanger.

27. The system of claim 25, wherein the first heat exchanger further comprises an ortho-para conversion (OPC) catalyst and is configured to flow the gaseous hydrogen through the OPC catalyst.

28. The system of claim 25, further comprising a compressor operable to compress the gaseous hydrogen before flowing the gaseous hydrogen through the first heat exchanger.

29. The system of claim 17, wherein the first heat exchanger further comprises an ortho-para conversion (OPC) catalyst and is configured to flow the gaseous hydrogen through the OPC catalyst.

30. The system of claim 17, wherein the first refrigerant comprises liquefied natural gas, liquefied nitrogen, or a combination thereof.

* * * * *